United States Patent [19]

Abrams

[11] Patent Number: 4,524,715

[45] Date of Patent: Jun. 25, 1985

[54] APPARATUS FOR APPLYING A COATING MATERIAL

[76] Inventor: William C. Abrams, 215 N. Avenue East, Cranford, N.J. 07016

[21] Appl. No.: 480,322

[22] Filed: Mar. 30, 1983

[51] Int. Cl.[3] ..... B05C 1/08; B05C 1/16

[52] U.S. Cl. ..... 118/221; 118/64; 118/245; 118/249; 118/261

[58] Field of Search ..... 118/245, 64, 228, 250, 118/261, 221, 249, 258, 718; 271/311, DIG. 2; 354/318

[56] References Cited

U.S. PATENT DOCUMENTS

| | | | |
|---|---|---|---|
| 872,392 | 12/1907 | Von Auw | 118/245 |
| 3,294,060 | 12/1966 | McIntyre et al. | 118/261 |
| 3,607,180 | 9/1971 | Merz et al. | 427/366 |
| 3,608,515 | 9/1971 | Tobias | 118/245 |
| 3,752,114 | 8/1973 | Knight | 118/245 |
| 3,938,950 | 2/1976 | Weiler et al. | 118/245 |

*Primary Examiner*—John P. McIntosh

*Attorney, Agent, or Firm*—Lerner, David, Littenberg, Krumholz & Mentlik

[57] ABSTRACT

An apparatus is disclosed for applying a coating material to a sheet material which is particularly useful in connection with preventing evaporation or drying out of the coating material when the apparatus is not in use. The apparatus basically includes a reservoir for containing a supply of coating material and an applicator roll having an applicator surface or surfaces thereon which is rotatably mounted in the reservoir so that coating material is received by the applicator surfaces and applied to the sheet material which is placed in contact therewith during rotation of the applicator roll. In accordance with one aspect, the applicator roll includes a plurality of substantially cylindrical applicator surfaces along the length thereof separated by a plurality of grooves, and a deflector device is provided having protruding portions disposed in the grooves of the applicator roll to cause the sheet material in contact with the applicator roll to separate from the applicator roll and be moved onto raised surface portions of the deflector device, the raised surface portions being such as to prevent contact of the coated surface of the sheet material with the downstream surface of the apparatus as the sheet material leaves the applicator roll. In accordance with other aspects of the apparatus, devices for sealing the reservoir and applicator roll from exposure to the surrounding atmosphere are provided. Additionally, a doctor blade mechanism for controlling the thickness of coating material received on the applicator roll during rotation is disclosed by which the position of the doctor blade with respect to the applicator surface of the applicator roll may be adjusted from a location displaced from the path of movement of a sheet material being fed to the applicator roll.

39 Claims, 13 Drawing Figures

42
46
44
66a
84
66b
82
86
66
80
8
48
74
72
76
70
36a
50
48a
36
64
78

APPARATUS FOR APPLYING A COATING MATERIAL

FIELD OF THE INVENTION

The present invention relates to a coating apparatus for applying coating materials to sheet materials or items, either in continuous form such as webbing materials or individual, different sized items. The sheet items may be of paper, cloth, plastic or other materials to which a coating material is to be applied. More particularly, the present invention has particular application in connection with preventing evaporation or drying out of the coating material by sealing of the coated material and related components from exposure to the surrounding atmosphere when the apparatus is not in use. The apparatus in accordance with the present invention has particular application in connection with the making of graphic art mockups, layouts and the like. However, it will be appreciated that the present invention may also be used in connection with the application of coating materials to sheet items in general.

BACKGROUND OF THE INVENTION

As is well known, in making graphic art mockups, layouts and the like, it is necessary to affix photographs, writing material, pictures, or other reproduction proofs, etc., to a background sheet of material, such as for example paper or cardboard backing. Often times, in making such mockups and layouts, it is necessary to reposition the photographs or other reproduction proofs after they have been affixed to the background sheet. Thus, it is desirable that the photographs and other reproduction proofs be coated with a pressure sensitive or other releasable types of adhesive which permits the photographs, materials, pictures, etc. to be affixed and repositioned many times in order to obtain a desired pattern or layout.

Generally in the prior art, the pressure sensitive or other adhesives utilized comprise some form of wax material. In order to apply such wax material to the sheet items, various types of wax coaters are known. Such applicators generally include suitable heater devices of some kind to keep the wax in a molten or fluid state. Further, the reservoir for the molten wax material is generally open to the surrounding atmosphere such that the wax material will tend to evaporate and/or dry out during nonuse.

While other types of adhesive or glue materials are known which do not require heating, such adhesive materials usually employ a solvent to keep the adhesive in a fluid state and which must also be capable of evaporating rapidly in order to bond the adhesive coating to the sheet items. This thus creates a problem in connection with open container systems, since the solvent materials tend to continually and prematurely evaporate while in the adhesive mixture.

U.S. Pat. No. 3,608,515 is directed to an applicator apparatus in which an adhesive mixture containing a solvent is held in a reservoir and is kept from evaporating from the reservoir by employing a relatively large housing which substantially completely encloses the reservoir, applicator member, and related components from the atmosphere which surrounds the housing. The housing includes a sealing cover which is adapted to be moved away from the path along which a sheet or webbing material passes when it is desired to apply an adhesive to the sheet material. In this manner, the applicator member is exposed to apply a coating to the sheet or webbing material. When the apparatus is not in use, the sealing cover is positioned to seal the interior of the housing from the surrounding atmosphere to prevent evaporation and drying out of the adhesive material and/or solvent within the reservoir.

The present invention is directed to an improved apparatus for applying coating materials to sheet materials which is particularly useful in connection with providing a substantially compact, closed system of a simplified construction for the coating material and related components in contact therewith when the apparatus is not being used, and thus is generally directed to improvements over the arrangement shown and described in U.S. Pat. No. 3,608,515. In particular, the present invention is directed to improvements with respect to means for separating the sheet materials from the applicator roll as the sheet material is moved therepast, as well as improvements in connection with sealing of the coating materials and components in contact therewith when the apparatus is not in use so as to provide a very compact and yet sealed system. Further, improvements in connection with providing adjustment of the coating thickness to be applied to the sheet materials are also disclosed.

SUMMARY OF THE INVENTION

In accordance with one aspect of the present invention, there is provided an apparatus for applying coating materials to a sheet material which comprises reservoir means for containing a supply of coating material, and an applicator roll which includes a plurality of substantially cylindrical applicator surfaces along the length thereof separated by a plurality of grooves. The applicator roll is rotatably mounted with respect to the reservoir means so that coating material is received by the applicator surfaces and applied to a sheet material placed in contact therewith during rotation of the applicator roll and so that the applicator roll then moves the sheet material during rotation in a direction toward a downstream surface located downstream of the applicator roll. Deflector means are provided for the applicator roll which include protruding portions and raised surface portions thereon. The deflector means is supported with respect to the applicator roll so as to be disposed intermediate the applicator roll and the downstream surface so that the protruding portions are disposed in the grooves of the applicator roll to cause the sheet material being moved by the applicator roll to separate from the applicator roll and be moved onto the raised surface portions. The raised surface portions are such as to prevent contact of the coated surface of the sheet material with the downstream surface as the sheet material leaves the applicator roll.

In this manner, effective separation of the sheet material from the applicator roll will be provided. This is particularly important in connection with the coating of adhesive materials since otherwise, without the provision of some means for causing separation of the sheet material from the applicator roll, the sheet material will simply adhere to the applicator roll and, upon continued rotation of the applicator roll, become completely submerged in the adhesive reservoir. Furthermore, by virtue of the raised surface portions, smearing of the adhesive on the surface of the sheet material will be effectively prevented, as will sticking of the coated items to the downstream surfaces, since the raised portions serve to maintain the coated surface of the sheet material from contact with the immediate downstream surface surrounding the reservoir means. This thus allows the coating material on the surface of the sheet material to set up or cure as it leaves the applicator roll. With quick drying adhesives, the small lag time provided will be sufficient to allow the coating material to dry on the surface of the sheet material before it comes in contact with any interfering downstream surface. Further, in accordance with a preferred embodiment of the present invention, the raised surface portions are aligned with the grooved sections of the applicator roll so that as the sheet material is moved onto the raised surface portions, the surface portions will contact the sheet material between the coated sections of the sheet material. This is also particularly advantageous in allowing the adhesive or other coating material to cure or set up upon exiting of the sheet material from the applicator roll.

In accordance with another aspect of the present invention, the apparatus comprises housing means for providing a substantially enclosed interior and in which there is provided reservoir means for containing a supply of coating material to be coated on a sheet material. A rotatable applicator roll is mounted in the interior of the housing means for receiving a coating material from the reservoir means and then applying the coating material to a sheet material. The housing means is sealable to seal the interior thereof from exposure to the surrounding atmosphere, and includes movable opening means for providing access for a sheet material to the rotatable applicator roll. The housing means further includes at least one wall having an aperture therein of a predetermined size. A shaft, operatively coupled to the rotatable applicator roll for rotation therewith, extends through the aperture in the wall of the housing means. Additionally, sealing means are provided for sealing the aperture to prevent exposure of the interior of the housing means to the atmosphere through the aperture. The sealing means has an outer peripheral dimension which is greater than the predetermined size of the aperture through which the shaft extends and is disposed to be in contact with the portion of the wall surrounding the aperture to thereby create a seal between the aperture and the sealing means. Additionally, the sealing means has a cylindrical transverse bore therethrough for receipt of the shaft. The interior of the bore includes an inner groove therein and the shaft includes an outer groove thereon disposed to be in alignment with the inner groove of the bore. Ring sealing means are provided which include an inner portion disposed in the outer groove of the shaft and an outer portion disposed in the inner groove of the bore to thereby provide an effective seal for the shaft and aperture in the wall of the housing means.

This arrangement thus provides a convenient and effective means for insuring that the interior of the housing means is sealed from the surrounding atmosphere, while at the same time providing a simplified arrangement by which a drive device and suitable coupling means may be exteriorly arranged with respect to the housing means and operatively connected to the applicator roll. Accordingly, the size of the sealable housing means may be kept to a minimum, since it is not necessary to mount the drive device and coupling means within the sealable housing. Rather, the reservoir containing the supply of coating material and the applicator roll need only be effectively sealed by the housing means, with the drive shaft for rotating the applicator roll extending exteriorly of the housing means through a suitable aperture, with suitable and effective sealing means serving to seal the aperture.

In accordance with a still further aspect of the present invention, the movable opening means of the sealable housing includes a movable wall member. The movable wall member includes an elongated aperture therein, and a shaft which is operatively coupled to the rotatable applicator roll extends through the elongated aperture in the movable wall member. The elongated aperture is sized so that movement of the movable wall between its sealed position and its open position does not effect movement of the shaft. Sealing means which comprises a cover member having a bore therethrough sized to sealingly receive the shaft therein is provided for sealing the aperture to prevent exposure of the interior of the housing means to the atmosphere through the aperture. The movable wall member includes a recessed portion surrounding the aperture for receiving the cover member therein so as to be in contact with the wall member. The dimensions of the cover member are greater than the dimensions of the elongated aperture and less than the dimensions of the recessed portion of the movable wall, and the cover member is so arranged in the recessed portion that it covers and seals the elongated aperture irrespective of the position of the movable wall member.

Such an arrangement provides an effective seal to prevent exposure of the interior of the housing means to the atmosphere through the aperture through which the shaft extends when the shaft extends through the wall of a movable member. For instance, this arrangement is particularly useful in connection with a sealed system in which a dome member is provided for the reservoir containing the supply of coating material and the rotatable applicator roll, the dome member being movable between a sealed position when the apparatus is not in use and an open position for providing access to the applicator roll, and in which a guide roll is arranged within the dome member having a shaft extending through the aperture of a wall of the movable dome member. In essence, the sealing cover member in accordance with this aspect of the present invention provides a convenient sealing arrangement while still permitting limited movement of the dome member with respect to the shaft of the guide roll.

Still further in accordance with the present invention, there is provided an adjustable doctor blade which is positioned in the housing means for controlling the thickness of coating material received by the applicator roll during rotation of the applicator roll. The doctor blade is mounted so as to be parallel to the axis of the rotatable applicator roll and movable between first and second positions along a direction transverse to the axis of the applicator roll to adjust the spacing between the doctor blade and the applicator surface of the applicator roll. A movable adjustment member for adjusting the position of the doctor blade between the first and second positions is provided, the adjustment member being mounted externally of the housing means out of the path of movement of the sheet material and positioned so as to be accessible during feeding of the sheet material to the applicator roll. Coupling means are provided for coupling the adjustment member to the doctor blade for effecting movement of the doctor blade between the first and second positions in response to movement of the adjustment member, the coupling means being coupled to act upon the doctor blade at two spaced positions along its length in a manner to insure that the doctor blade remains parallel to the axis of the applicator roll during adjustment of its position.

Such an arrangement is particularly useful in connection with a sealable applicating system in order to provide the capability of adjusting the thickness of the coating to be applied to the sheet material without the necessity of having to expose the interior of the sealable housing means to the surrounding atmosphere, thereby possibly leading to evaporation and/or loss of coating material during such an adjustment operation. In this regard, arrangement of the adjustment member so as to be out of the path of movement of the sheet material and still accessible during a coating operation allows for convenient adjustment of the position of the doctor blade with respect to the applicator surface of the applicator roll.

These and further features and characteristics of the present invention will be apparent from the following detailed description in which reference is made to the enclosed drawings which illustrate preferred embodiments of the present invention.

DETAILED DESCRIPTION OF THE PREFERRED EMBODIMENTS

Figure 1:
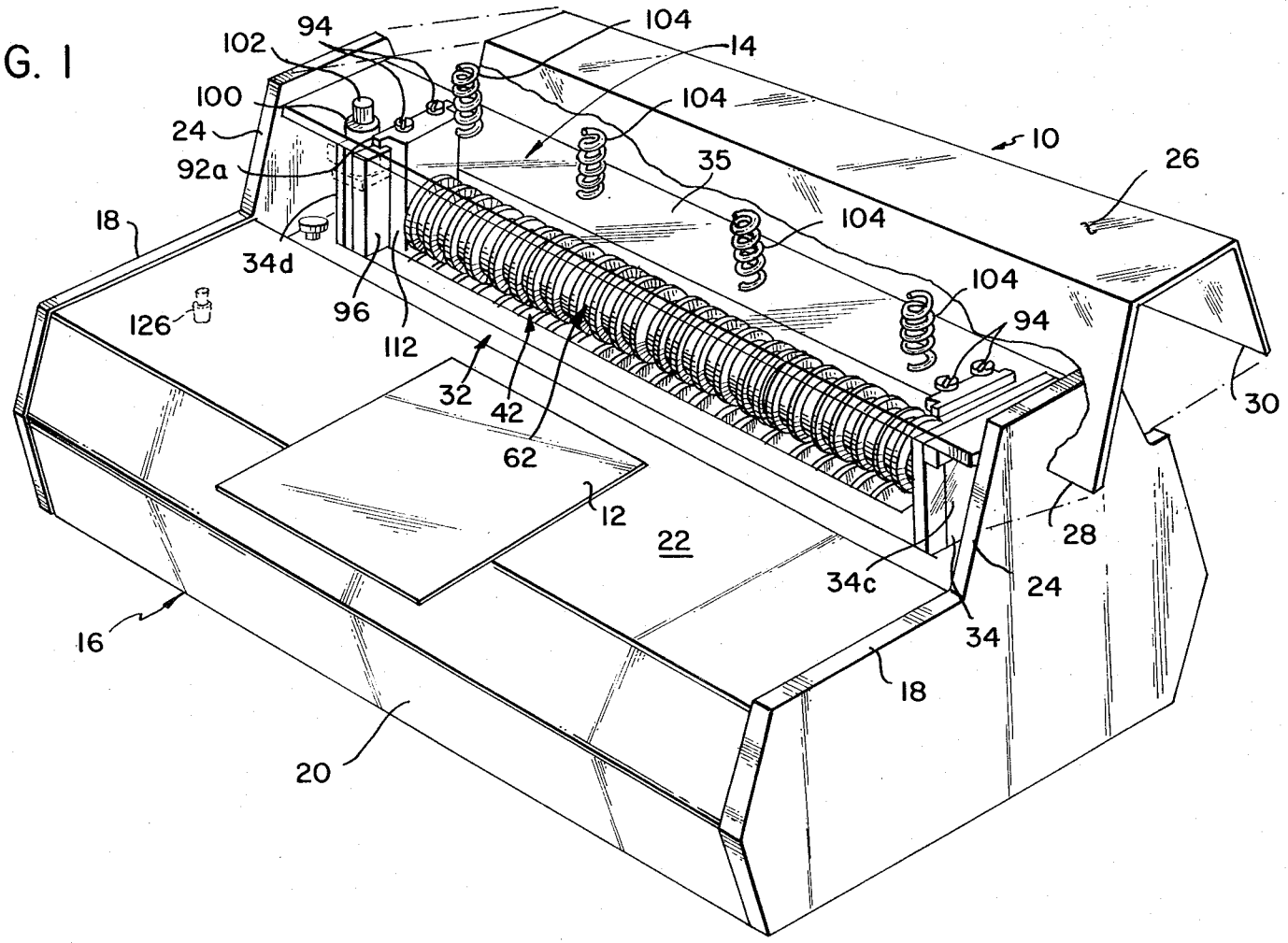
FIG. 1 is a front perspective view of an apparatus for applying a coating material in accordance with the present invention.

Referring now to the drawings wherein like reference characters represent like elements, there is shown in FIG. 1 a perspective view of an apparatus 10 for applying a coating material to a sheet material 12 in accordance with the present invention. The apparatus 10 in accordance with the present invention is particularly useful in connection with minimizing evaporation or drying out of a liquid coating material contained therein when the apparatus 10 is not in use by providing a substantially sealable enclosure 14 for the liquid coating material and components in direct contact therewith. At the same time, the apparatus 10 in accordance with the present invention provides a simplified design as a result of which the size of the sealable enclosure 14 is kept to a minimum, with the various drive and coupling mechanisms therefor being located externally of the sealable enclosure 14. Basically, the apparatus 10 in accordance with the present invention provides an apparatus of a compact design which is simple to operate in the hands of inexperienced operators, and which allows accurate, high-speed, low cost coating of a multitude of different types of adhesives, glues, or other coating materials.

The apparatus 10 is particularly useful in connection with applying liquid materials such as adhesives or glues for use in connection with providing paste-up items, such as used in the graphic arts field. However, it will be appreciated by persons skilled in the art that the apparatus in accordance with the present invention can also be used for applying a coating material to other types of sheet material 12 for other uses. In particular, the apparatus 10 may be used in connection with virtually any type of liquid coating material, such as, for example, all types of adhesives and glues. For instance, the liquid adhesives may comprise natural and synthetic resins, vegetable glues, and water soluble cements (e.g., latex). Still further, the coating material may comprise adhesives which are pressure sensitive in order to permit the coated items 12 to be applied, lifted and repositioned many times without transference of the pressure sensitive adhesive to the backing material. One such type of pressure sensitive adhesive which can be used with the present invention comprises a nonflamable white water adhesive which will provide a true pressure sensitive coating which dries to a permanently tacky film in about 45 seconds after being applied and exposed to the atmosphere. The coating thickness required in accordance with this type of adhesive is about one-fifth of that which is required for other adhesives. Also, the tack of the adhesive may be controlled to provide adherence with a light touch, but still permit the coated items 12 to be easily removed or repositioned many times.

Figure 2:
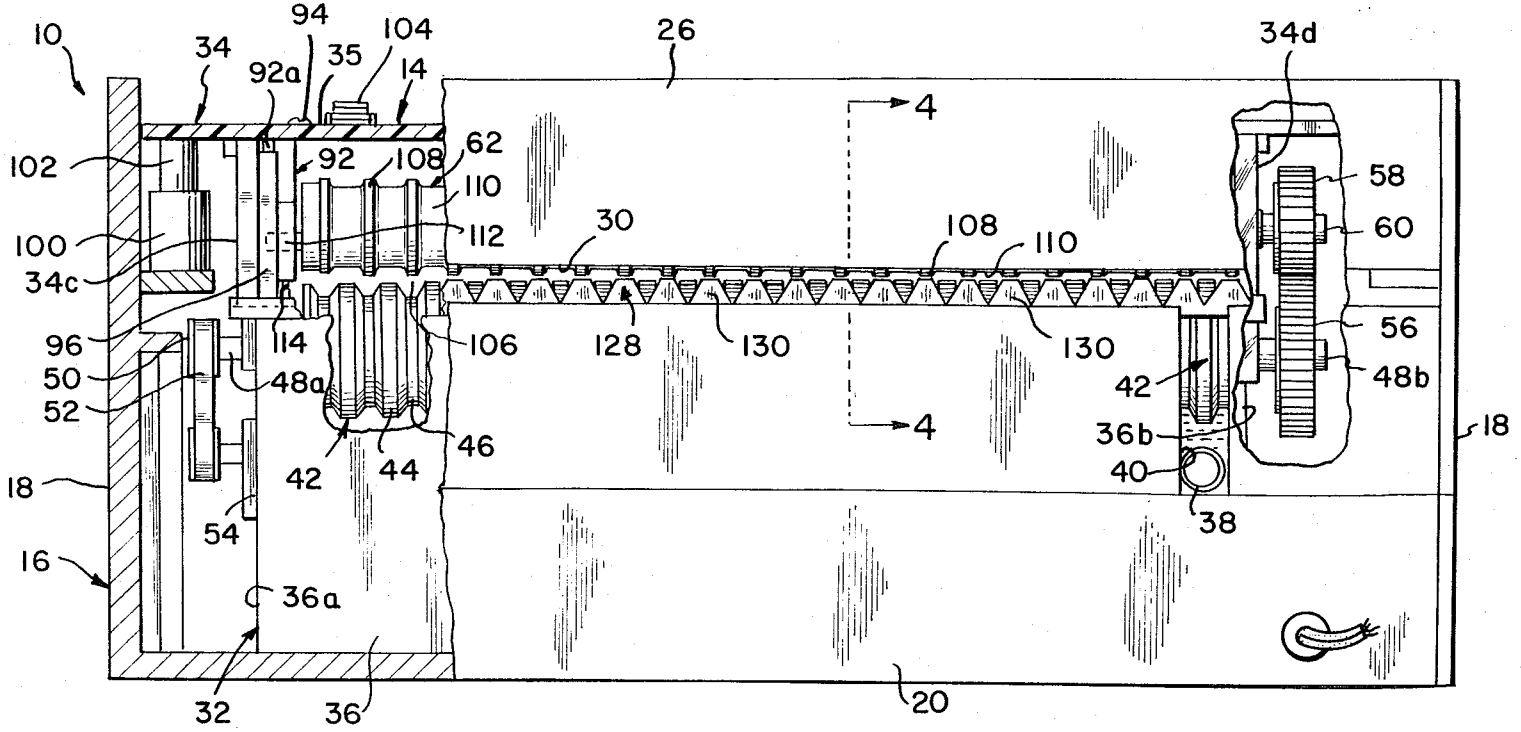
FIG. 2 is a rear elevational view, partly in section and partly broken away, to illustrate the various components of the apparatus and arrangement thereof in accordance with the present invention.

Referring now to FIGS. 1 and 2, the apparatus 10 in accordance with the present invention includes an outer casing 16 in which the various components and mechanisms of the apparatus 10 are housed. The casing 16 comprises a pair of upstanding sidewalls 18 joined together by a generally U-shaped base section 20. A front feed plate 22 is provided which extends between the sidewalls 18 of the casing 16 to provide a surface for feeding of sheet items 12 to a closable applicator housing 14 provided in the rear of the casing 16, the applicator housing 14 providing the sealable enclosure for the liquid coating materials and related components. In the preferred embodiment, each of the sidewalls 18 includes an upwardly extending section 24 adjacent the closable applicator housing 14 onto which a casing cover 26 is adapted to be mounted. As shown in FIG. 1, the casing cover 26 is generally U-shaped and is adapted to be mounted to the upwardly extending sections 24 of the casing sidewalls 18 so that the lower front and rear edges 28, 30 thereof are vertically displaced above the elevation of the surface of the feed plate 22 to provide access to the applicator housing 14.

The applicator housing 14 mounted in the rearward section of the casing 16 includes a lower reservoir section 32 for containing a supply of coating material, such as a pressure sensitive adhesive liquid, to be applied to a sheet item 12, and an upper, movable dome section 34 which is adapted to move between a lower, sealed position (see FIG. 1) in which the interior of the housing 14 is substantially sealed from the surrounding atmosphere and a raised open position (see FIG. 4) in which the lower edges of the dome section 34 are displaced above the upper edge of the reservoir section 32 to provide access for a sheet item 12 thereto to be moved therethrough. In the preferred embodiment, the lower reservoir section 32 comprises a generally box-like container 36 having an open top and containing a liquid coating material therewithin. A tubular conduit 38 is affixed to the rearward side of the container 36 for continuously replenishing coating material into the adhesive container 36. Suitable means (not shown) may be provided for controlling the introduction of coating material so as to maintain a predetermined level or quantity of coating material in the container 36. The tubular conduit 38 is connected at its other end to a suitable source of supply of liquid coating material (not shown) and extends through a slotted opening 40 in the rear portion of the base section 20 of the casing 16 (see FIG. 2).

An applicator roll 42 is rotatably mounted in the upper end of the container 36 for receiving coating material in the container 36 and applying it to sheet items 12 as they pass through the applicator housing 14. As is best shown in FIGS. 1, 2, 4 and 5, the applicator roll 42 is of a grooved construction to provide a plurality of substantially cylindrical applicator surfaces 44 each separated by a cylindrical grooved section 46 along its length. Accordingly, it will be appreciated that the applicator roll 42 is effective to apply strips of coating material to the sheet item 12. The applicator roll 42 includes a central drive shaft 48 the ends **48*a*, 48*b* of which extend out of the opposite end walls 36*a*, 36*b* of the container 36. One end 48*a* of the applicator roll shaft 48 is provided with a gear 50 thereon which is coupled by a belt drive 52 to a suitable motor 54 mounted in the casing 16. The other end 48*b* of the applicator roll shaft 48 is also provided with a gear 56 thereon which is adapted to matingly engage a similar gear 58 attached to the shaft 60 of a guide roll 62**, as more fully explained hereinbelow.

In order to provide a substantially sealable applicator housing 14 in order to protect the contents of the container 36 from exposure to the surrounding atmosphere when the applicator apparatus 10 is not in use, suitable sealing means are provided for sealing the shafts 48, 60 and apertures through which they extend. More particularly, with reference to FIGS. 6–8, the opposite end walls **36*a*, 36*b* of the container 36 are each provided with an elongated aperture or slot 64 extending downwardly from the top edge of the container 36 and through which the shaft ends 48*a*, 48*b* of the applicator roll 42 extend. In the preferred embodiment, the sealing means for each end wall 36*a*, 36*b* comprise a two-part sealing member 66 adapted to be mounted in the aperture 64 together with an internal sealing arrangement for sealing the shaft ends 48*a*, 48*b* with respect to the two-part sealing member 66. As each of the sealing means for the opposite ends of the container 36** are identical, only one sealing means will be described.

One part **66*a* of the sealing means is substantially cylindrical and has a bore 68 therethrough for receiving one end 48*a* of the applicator roll shaft 48. The bore 68 includes a cylindrical grooved section 70 provided in the interior thereof. Each end 48*a*, 48*b* of the shaft 48 similarly is provided with a grooved section 72 thereon. A ring sealing member 74, such as an O-ring, is interposed between the cylindrically shaped part 66*a* and the end 48*a* of the shaft 48 by having an inner cylindrical portion of the ring sealing member 74 disposed in the groove 72 on the shaft 48 and an outer cylindrical portion disposed in the groove 70 in the cylindrically shaped part 66*a*. Such an arrangement will thus serve to prevent air from leaking between the cylindrically shaped part 66*a* and the shaft 48, while at the same time allowing the shaft 48** to rotate freely.

Figures 6, 7, 8:
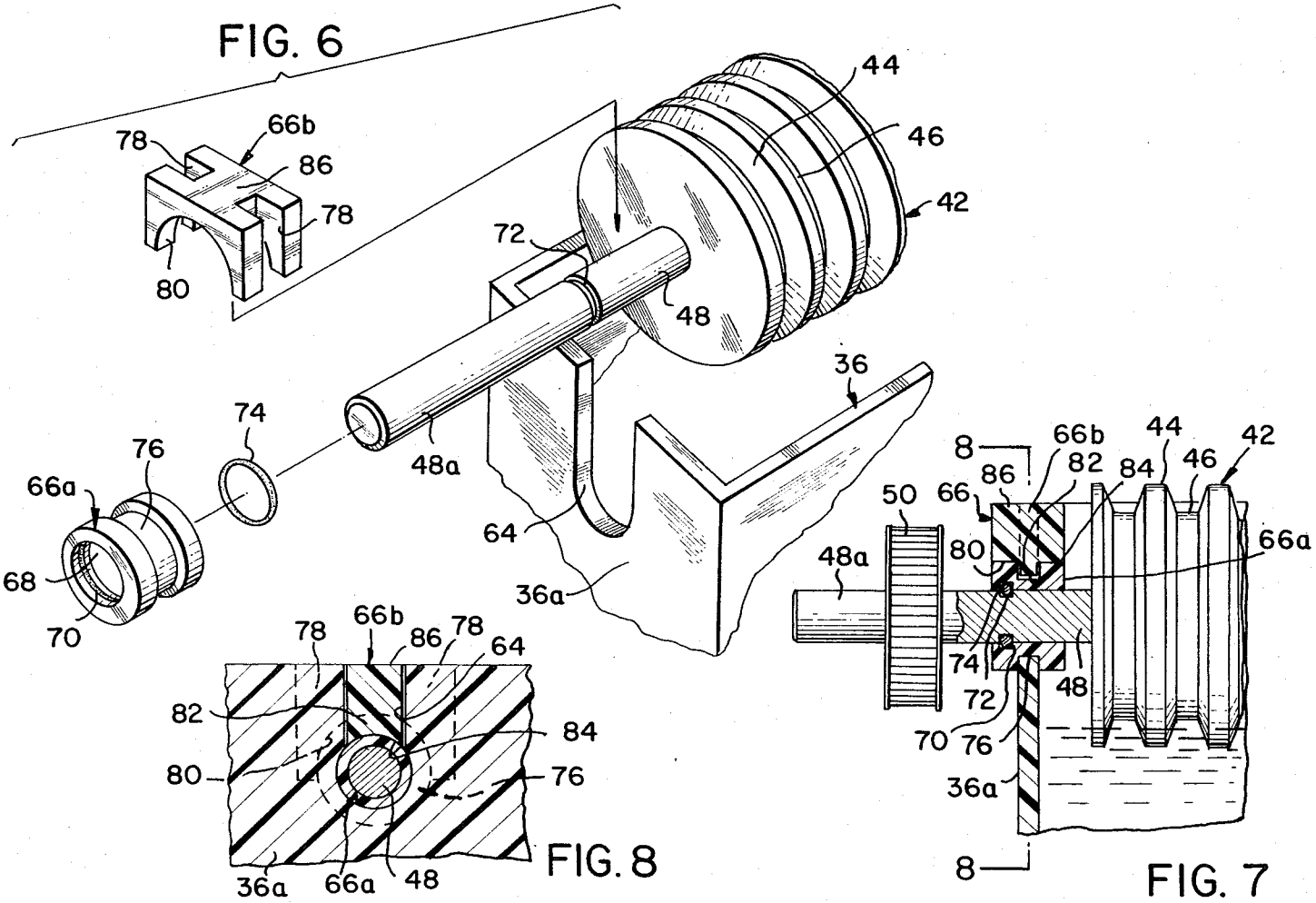
FIG. 6 is a exploded perspective view illustrating the manner in which the shaft of the applicator roll is sealed in the reservoir housing, in accordance with another aspect of the present invention.
FIG. 7 is a side sectional view illustrating the assembled arrangement shown in FIG. 6.
FIG. 8 is sectional view taken along the lines 8—8 of FIG. 7.

The cylindrically shaped part **66*a* has a peripheral outer dimension which is greater than the width of the elongated aperture 64 in the container end wall 36*a*, and is machined with a central grooved section 76 in its outer transverse surface which is sized to precisely fit in the aperture 64, as best seen in FIGS. 7 and 8. A second slotted sealing part 66*b* is also provided to complete the seal of the aperture 64. The second sealing part 66*b* has grooved sections 78 in the sidewalls thereof which also correspond to the width of the elongated aperture 64, and a concave cylindrically shaped lower surface 80 which corresponds to and is adapted to mate with the outer cylindrical surface of the cylindrical sealing part 66*a*. The concave cylindrically shaped lower surface of the second sealing part 66*b* is provided with a protruding tab section 82 which similarly has a concave cylindrically shaped lower edge 84 which is adapted to precisely fit into and mate with the grooved section 76 of the cylindrical sealing part 66*a*, as best shown in FIG. 8. The upper service 86 of the second sealing part 66*b* is substantially flat so as to provide a substantially flat upper edge for the container 36 when the applicator roll 42 and sealing means 66, 74 are installed in the elongated aperture 64 of the end wall 36*a* of the container 36**.

In this manner, a perfect and complete seal for the elongated apertures 64 in the end walls **36*a*, 36*b* of the container 36 through which the shaft ends 48*a*, 48*b* of the applicator roll 42 extend is provided. Advantageously, the two-part sealing member 66*a*, 66*b* may be made of a suitable plastic material, such as Delrin, and the O-ring sealing member 74 may, for example, be made of Teflon. The sealing means 66, 74 will thus serve to completely seal the interior of the housing 14 from exposure to the surrounding atmosphere via the apertures 64 in the container end walls 36*a*, 36*b*, while at the same time supporting the shaft 48 of the applicator roll 42 so as to rotate freely therein. It will thus be appreciated that with such an arrangement, the drive means 50, 52, 54 for driving of the shaft 48 of the applicator roll 42** can be located externally of the applicator housing 14, and therefore need not be sealed from the atmosphere.

The upper open end of the container 36 is provided with a cover plate 88 which tightly fits around the upper edge of the container 36 in a suitable manner to prevent leakage of air into the interior of the container 36 between the upper edge of the container 36 and the surrounding cover plate 88. The cover plate 88 is provided with a central elongated opening 90 therein through which the upper portion of the applicator roll 42 (see FIG. 4) extends slightly so as to be accessible for receipt of a sheet item 12 moved along the top surface of the cover plate 88. It will be noted from FIG. 4 that the uppermost extent of the applicator roll 42 extends slightly above the upper surface of the cover plate 88. Deflector means 128 are also mounted on the rearward or downstream section of the cover plate 88, to be described more fully hereinbelow, for causing separation of the sheet item 12 from the applicator roll 42.

Figure 10:
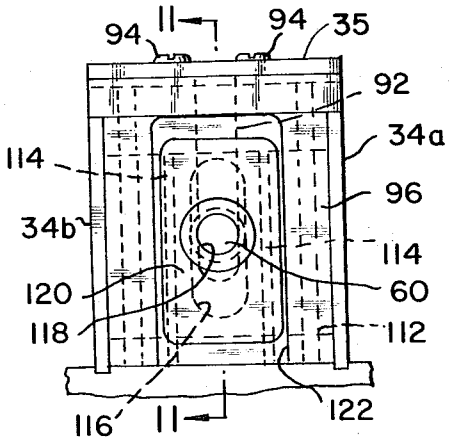
FIG. 10 is an end elevational view of the assembled arrangement shown in FIG. 9.
Figure 11:
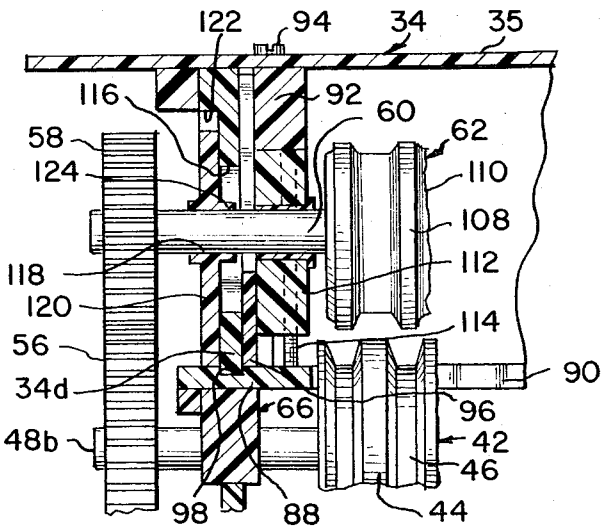
FIG. 11 is a side sectional view taken along the lins 11—11 of FIG. 10.
Figure 9:
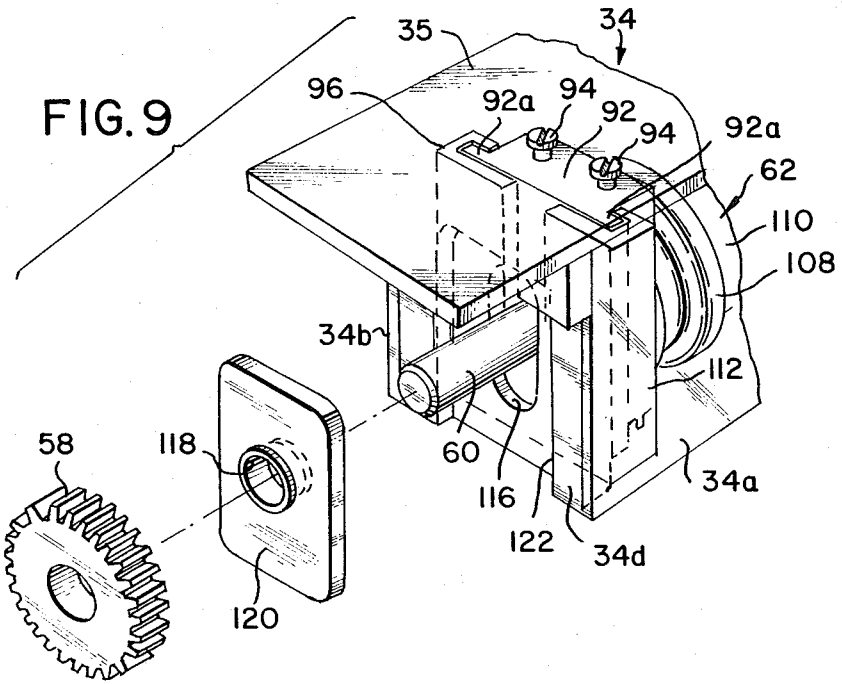
FIG. 9 is an exploded perspective view illustrating the manner of mounting and sealing the shaft of a guide roll in the movable dome section of the apparatus in accordance with a further aspect of the present invention.

The movable dome section 34 of the applicator housing 14, when in the closed position, serves to close off the opening 90 in the cover plate 88 to substantially seal the interior thereof from exposure to the atmosphere, and when in the open position, serves to provide access for a sheet item 2 to the applicator roll 42. The dome section 34 comprises a generally rectangular box-like member having front and rear walls 34*a*, 34*b*, a pair of opposite end walls 34*c*, 34*d*, and a top wall 35, the ends of which extend beyond the end walls 34*c*, 34*d*, joined together as a unitary structure. Preferably the dome section 34 is constructed of a transparent plastic material such as plexiglass so as to permit viewing into the interior of the housing 14. A pair of slide members 92 are secured to the top plate 35 in the interior of the dome section 34 in a suitable manner, such as by screws 94. As best seen in FIGS. 9–11, the slide members 92 each include protruding side legs 92*a* which are adapted to be received in grooved sections of a pair of upstanding guide tracks 96 secured to the upper surface of the cover plate 88 outside of the elongated opening 90 therein. This arrangement permits vertical movement of the dome section 34 between the closed and open positions. Also, it will be noted from FIG. 3 that there is provided a recessed groove 98 in the cover plate 88 about the elongated opening 90 into which the lower edge of the dome section 34 is adapted to extend when the dome section 34 is lowered to its closed sealed position. In this manner, an effective sealing of the opening 90 in the cover member 88 is provided.

In order to effect movement of the dome section 34 between the sealed and opened positions, suitable solenoids 100 (one of which is shown in FIG. 2) are mounted to the upwardly extending sections 24 of the inner casing side walls 18. Each of the solenoids 100 include a plunger 102 for engaging the underside of the extended portions of the top plate 35 of the dome section 34. Upon actuation of the solenoid members 100, the plungers 102 move upwardly to lift the dome section 34 off of the cover member 88 of the container 36. Preferably, the dome section 34 is lifted approximately $\frac{1}{4}''$ to thereby provide access to the interior of the applicator housing 14. In this regard, during the lifting operation, the slide members 92 are guided for precise vertical movement by the upwardly extending guide tracks 96. Upon deactuation of the solenoid members 100, the plungers 102 retract, and springs 104, mounted between the casing cover 26 and the top plate 35 (see FIG. 1), serve to move the dome section 34 downwardly into the sealing position, with the lower edges of the dome walls 34 being received in the recessed groove 98 of the cover plate 88 on the container 36.

Inside the dome section 34 of the applicator housing 14, there is also provided a grooved guide roll 62 which is mounted so as to be positioned vertically above the applicator roll 42 in spaced relationship so as to define a feed channel 106 therebetween through which sheet items 12 may be moved. As best seen in FIG. 2, the guide roll 62 includes a plurality of raised cylindrical surfaces 108 separated by recessed grooved sections 110. The guide roll 62 is positioned with respect to the applicator roll 42 so that the raised cylindrical surfaces 108 of the guide roll 62 are aligned with the grooved sections 46 of the applicator roll 42, and the grooved sections 110 of the guide roll 62 are aligned with the raised applicator surfaces 44 of the applicator roll 42. The positioning of the guide roll 62 relative to the applicator roll 42 is such that a very small gap or channel 106 is defined between the elevation of the applicator surfaces 44 of the applicator roll 42 and the raised cylindrical surfaces 108 of the guide roll 62. The height of this feed channel 106 is preferably controlled to correspond to approximately the thickness of the sheet items 12 to be coated so that as the sheet items 12 are introduced into and through the feed channel, the guide roll 62 will effectively urge the lower surface of the sheet items 12 into contact by the applicator surfaces 44.

In order to adjust the positioning of the guide roll 62 with respect to the applicator roll 42, adjustable mounting blocks 112 are provided for mounting the guide roll 62 for rotation within the dome section 34. More particularly, the opposite ends of the shaft 60 of the guide roll 62 are rotatably mounted in suitable bearings in slidable bearing blocks 112 which are provided with protruding side legs (similar to side legs 92*a* of slide members 92) sized to be received within the grooved portions of the vertically extending guide tracks 96 mounted on the cover plate 88. As best seen in FIGS. 9–11, the slidable bearing blocks 112 are arranged beneath the slide members 92 secured to the top plate 35 of the dome section 34, and are each provided with a pair of threaded members 114 extending from the lower surface thereof which are adapted to rest on the upper surface of the cover plate 88. The threaded members 114 in each bearing block are provided on opposite sides of the shaft 60 of the guide roll 62. By proper adjustment of the threaded members 114, the position of the slidable bearing blocks 112 (and thus the guide roll 62) relative to the cover member 88 (and thus relative to the applicator roll 42) can be controlled to thereby control the position of the guide roll 62 relative to the applicator roll 42.

As best seen in FIG. 2, at one end the shaft 60 for the guide roll 62 extends outwardly through the end wall 34*d* of the dome section 34 and has a gear 58 thereon for mating engagement with the gear 56 provided on the corresponding end of the shaft of the applicator roll 42 so that rotation of the applicator roll 42 will effect rotation of the guide roll 62. At the other end, the dome section 34 is completely closed with the end of the shaft 60 of the guide roll 62 terminating in its slidable bearing block 112.

It will be appreciated that in order to permit raising and lowering of the dome section 34 relative to the lower reservoir section 32, the shaft 60 of the guide roll 62 extending out through the one end wall 34*d* of the dome section 34 must be provided with a slotted aperture 116 (see FIG. 9) to permit limited vertical movement of the dome section 34 with respect to the lower reservoir section 32 since the position of the guide roll 62 is to remain substantially fixed with respect to the applicator roll 42 when the dome section 34 is moved to its opened position. In order to prevent exposure of the interior of the applicator housing 14 to the surrounding atmosphere through the slotted aperture 116, particularly when the dome section 34 is in its closed position, a suitable sealing member 120 for sealing such aperture 116 is provided.

Referring to FIGS. 9–12, the sealing member 120 comprises a cover seal member made of a suitable low friction material, such as teflon, having a bore 118 therethrough for receipt of the shaft 60 of the guide roll 62. The cover seal member 120, whose peripheral dimensions are greater than the size of the aperture 116, is adapted to engage the outer end wall **34*d* of the dome section 34 about the aperture 116 to effectively create a seal against leakage through the aperture 116, irrespective of the position of the dome section 34. The bore 118 in the cover seal member 120 is sized to tightly receive the shaft 60 of the guide roll 62 therethrough in a sealing arrangement but such as to permit rotation thereof. In this regard, a double grooved seal arrangement together with a sealing ring, such as used for sealing the shaft 48 of the applicator roll 42, could be provided, although, in some instances, simply providing a relatively tight fit for the shaft 60 in the bore 118 may be sufficient to minimize any substantial leakage into the interior of the housing 14**.

As best seen in FIGS. 9 and 10, the outer surface of the end wall **34*d* of the dome section 34 through which the guide roll shaft 60 protrudes includes a recessed area 122 about the slotted elongated aperture 116 therein. Preferably, the depth and width of the recess 112 corresponds to the thickness and width of the cover member 120, while the length of the recess 122 exceeds the length of the cover member 120. In this manner, the cover member 120 may be received in the recess 122 to be in sealing contact with the rear wall of the recessed area 122 and slidably movable in the vertical direction. The length of the recess area 122 and of the cover member 120 is dependent on the size of the aperture 116 and the extent of vertical movement of the dome section 34 which is desired. For example, if movement of the dome section 34 between the sealed, closed position and the open position is to be approximately $\frac{1}{4}''$, the length of the cover member 120 must exceed the length of the aperture 116 by $\frac{1}{4}''$, and further the length of the recess 122 must exceed the length of the cover member 120 by $\frac{1}{4}''$ as well, i.e., exceed the length of the aperture 116 by $\frac{1}{2}''$. Preferably, the length of the cover member 120 is at least $\frac{1}{2}''$ greater than the length of the aperture 116 in order to permit adjustment of the position of the guide roll 62 relative to the applicator roll 42 while still maintaining the sealed arrangement of the aperture 116**.

The width of the elongated aperture 116 is preferably greater than the diameter of the shaft 60, and a raised hub 124 is preferably provided on the rear surface of the cover member 120 which is sized to be received in the aperture 116. This arrangement is desirable in order to provide an effective guide to permit vertical movement of the dome section 34, while at the same time providing an effective seal against leakage.

Thus, it will be appreciated that in this manner, the shaft 60 of the guide roll 62 may protrude from the end **34*d* of the dome section 34 through an appropriate slotted aperture 116 to receive a gear 58 thereon for mating engagement with the similar gear 56 on the applicator roll shaft 48, as shown in FIG. 2. The cover member 120 effectively seals the aperture 116 against the leakage of air into the interior of the applicator housing 14 to prevent exposure of the contents therein to the surrounding atmosphere. Further, it will be appreciated that no interference with respect to movement of the dome cover section 34 from the sealed position to the open position will be created by the cover member 120, the cover member 120 effectively sealing the slotted aperture 116 against leakage of air irrespective of the position of the dome section 34 between its opened and sealed positions. Furthermore, during movement of the dome section 34 to its opened position, the position of the guide roll 62 remains fixed with respect to the applicator roll 42. Still further, because of the support arrangement of the guide roll 62 in the sliding bearing block 112, adjustment of the position of the guide roll 62 with respect to the applicator roll 42 can be obtained by adjustment of the threaded screw members 114 provided in the bearing blocks 112**.

Accordingly, with the sealable applicator housing 14 in accordance with the present invention, a completely sealable enclosure for the container 36 and applicator roll 42 can be provided to minimize exposure of the coating material and components in contact therewith to the surrounding atmosphere, which might otherwise lead to evaporation and drying out of the coating material. The movable dome section 34 permits access to the applicator roll 42 during use to apply a coating to sheet items 12, and yet serves to close and seal the interior of the housing 14 during nonuse. Further, the drive and coupling mechanisms 50, 52, 54, 56, 58 for driving the applicator roll 42 and guide roll 62 may conveniently be located externally of the sealable housing 14 and still a substantially closed interior for the housing may be provided by virtue of the sealing means 66, 74, 120 for the shafts 48, 60 of the applicator and guide rolls 42, 62.

As noted above, when the applicator apparatus 10 is not being used to apply coating material to sheet items 12, and also during any period of nonuse such as between coating operations, the movable dome section 34 is in its lower, closed position to seal the interior of the applicator housing 14. In order to apply a coating material to a sheet item 12, the solenoids 100 in the casing 16 are actuated to cause the dome section 34 to be lifted to expose the applicator roll 42. This may be accomplished by depressing a suitable switch means to actuate the solenoids 100. Also, at the same time, the drive motor 54 may be actuated to rotate the applicator roll 42 via belt drive 52 and gear 50, and guide roll 62 via gears 56 and 58 on the shafts 48, 60 of the applicator and guide rolls 42, 63. In the preferred embodiment, the top feed plate 22 is mounted for limited vertical movement between the sidewalls 18 of the casing 16 so as to activate a microswitch 126 provided beneath the feed plate 22 (see FIG. 1) for simultaneously actuating the solenoids 100 and the drive motor 54. In this manner, simply by placing a sheet item 12 on the feed plate 22 and depressing same, the microswitch 126 will be tripped to thereby activate the solenoids 100 and simultaneously activate the drive motor 54 for rotating the applicator and guide rolls 42, 62. Such a mechanism provides for a convenient means for effecting operation in that it effectively frees the hands of an operator to precisely position the sheet materials 12 to pass same into and through the applicator housing 14.

Upon movement of the dome section 34 to its open position and actuation of the drive motor 54, the applicator roll 42 will be rotated to receive coating material from the container 36 onto the applicator surfaces 44, and to then apply same to the sheet items 12 as the sheet items 12 are introduced through the feed gap or channel 106 between the guide and applicator rolls 42, 62. During feeding, the guide roll urges the sheet item 12 into engagement with the applicator surfaces 44, and the coating material on the applicator surfaces 44 is transferred to the sheet item 12. As the coating material is generally of an adhesive character, it will be appreciated that the sheet items 12 may tend to be retained on the applicator roll 42 during rotation thereof. In order to separate the sheet items 12 from the applicator roll 42, deflector means 128 are provided at the exit or downstream end of the applicator roll 42.

Figure 3:
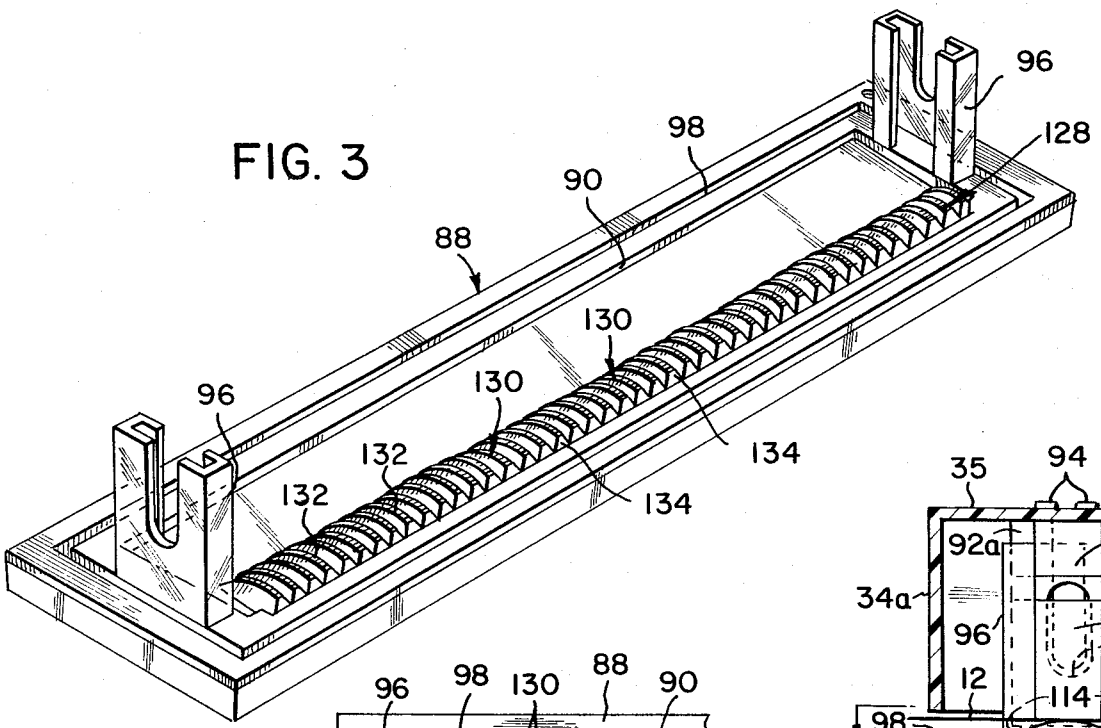
FIG. 3 is a perspective view of a cover member for a coating material reservoir which includes deflecting means in accordance with one aspect of the present invention.
Figure 4:
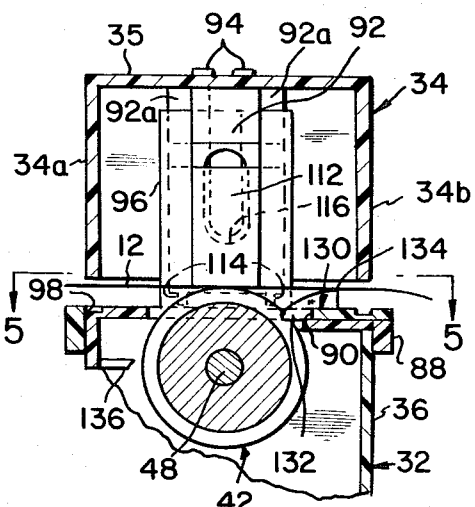
FIG. 4 is a side sectional view taken along the lines 4—4 of FIG. 2, and illustrating how a sheet item is separated from the applicator roll by the deflecting means shown in FIG. 3.
Figure 5:
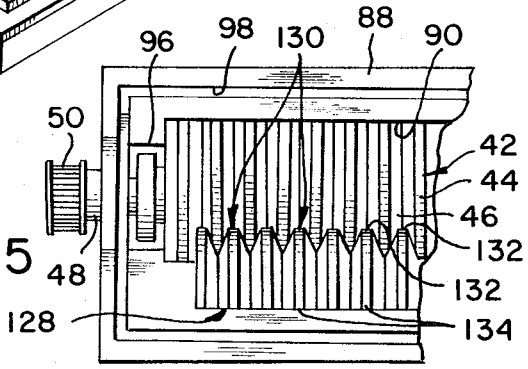
FIG. 5 is a top plan view of the applicator roll and deflecting means, taken along the lines 5—5 of FIG. 4, with the sheet item being removed to illustrate more clearly the arrangement of the deflecting means with respect to the applicator roll.

As best seen in FIGS. 3–5, the deflector means 128 in the preferred embodiment comprises a series of teeth 130 which each include a protruding portion 132 and a raised surface portion 134. The teeth 130 are arranged on the cover plate 88 so that the protruding portions 132 thereof extend into the grooved sections 46 of the applicator roll 42 with the raised surface portions 134 thereof being located downstream of the applicator roll 42, i.e., downstream in the feed direction of a sheet item 12. Preferably, the height of the raised surface portions 134 is substantially the same as the elevation of the raised applicator surfaces 44 of the applicator roll 42, as best shown in FIG. 4. In this manner, as the sheet item 12 in contact with the applicator roll 42 is moved by rotation of the applicator and guide rolls 42, 62, it will engage the deflector teeth 130 intermediate the protruding portions or ends 132 and the raised surface portions 134, and thus be forced onto the raised surface portions 134 of the deflector means 128, as illustrated in FIG. 4. This necessarily occurs since the protruding ends 132 of the teeth 130 extend into the grooved sections 46, thereby preventing passage of the sheet item 12 between the applicator roll 42 and the deflector means 128, and thus preventing the sheet items 12 from otherwise thereby being introduced into the rearward end of the container 36 and into the coating contained therein. Here it should be noted that because of the close spacing of the applicator surfaces 44, the sheet items 12 will not generally extend into the grooved sections 46. Accordingly, upon continued rotation of the applicator roll 42, the sheet item 12 is simply separated from the applicator roll 42 and moved outwardly toward the rearward end of the apparatus 10 with a coating of adhesive or other material having been applied to the lower surface thereof.

In this regard, it will be noted that the vertical elevation of the raised surface portions 134 at the extreme downstream end of the deflector teeth 130 is above the upper surface of the cover plate 88 so that upon exiting of the sheet item 12 from the applicator roll 42, the lower surface of the sheet item 12 will be raised above the surface of the cover plate 88. This is most advantageous in preventing smearing of the just-applied coating material on the lower surface of the sheet item 12 as well as possible transference of the adhesive coating to the downstream surface of the cover plate 88. Additionally, since the raised surface portions 134 are preferably aligned with the grooved sections 46 of the applicator roll 42, which do not contain adhesive thereon, the sheet item 12 upon exiting from the applicator roll 42 will be supported intermediate the strips of applied coating material. This also is advantageous in preventing smearing or loss of adhesive which has been coated onto the sheet item 12. This arrangement thus provides an effective means for allowing the adhesive to dry or cure, upon exiting from the applicator apparatus 10, to a suitable tack which will prevent transference of the applied adhesive coating to any items in which it comes into contact. In other words, it allows the adhesive to cure so that it will remain on the sheet items 12, and not be transferred to any of the surrounding apparatus or components.

It will of course be appreciated in this regard that although the raised surface portions 134 of the deflector teeth 130 are shown as having a short longitudinal dimension (i.e., in the downstream direction of travel), they could be of a longer length if additional time is required for curing of the adhesive on the coated items 12. Still further, additional means or devices could be provided which might, for example, invert the coated sheet items 12 as they exit from the apparatus 10.

Preferably, the deflector means 128 comprises a single member which has been either machined or molded to provide the desired protruding portions 132 and raised surface portions 134 separated by a series of grooves. The deflector means 128 may then be mounted on the cover plate 88, or alternatively, the deflector means 128 could be integrally formed with the cover plate 88 upon manufacture, such as through the use of an injection molding technique. What is important in accordance with this aspect of the present invention is that the protruding portions 132 of the deflector teeth 130 extend into the grooved sections 46, and that the raised surface portions 134 be provided so that upon the sheet item 12 being separated from the applicator roll 42 and exiting therefrom, it does not immediately contact the downstream surface of the cover plate 88. Further, preferably the raised surface portions 134 are also aligned with the protruding portions 132 so that the surface portions 134 do not themselves interfere with the just-applied coating upon exit of the sheet item 12 from the applicator housing 14.

In accordance with a still further aspect of the present invention, an adjustable doctor blade mechanism is provided within the lower reservoir section 32 for adjustably controlling the thickness of the coating to be applied to sheet items 12. As is well known, a doctor blade 136 for controlling the thickness of the coating carried by the applicator roll 42 may be arranged in the coating material container 36 so as to be positioned at a specified desired distance from the surface of the applicator roll 42. As the applicator roll 42 rotates past the doctor blade 136, excess coating received onto the applicator surfaces 44 is prevented from continuing past the doctor blade 136 and simply falls back into the container 36. Generally in this regard, the doctor blade 136 includes a knife edge which narrows in thickness toward the surface of the applicator roll 42. As can be appreciated, it is highly desirable to be able to adjust the setting of the doctor blade 136 with respect to the applicator surfaces 44 of the applicator roll 42 in order to provide for different thickness coatings, depending upon the nature of the sheet item, the intended use of the sheet item, etc. In this regard, adjustment of the position of the doctor blade 136 is generally accomplished by adjustment of the mounting of the doctor blade 136 in the container 36.

However, in accordance with the present invention, exposure of the interior of the housing 14 in order to accomplish such adjustment would also expose the contents of the container to the atmosphere, and thus provide the undesirable effects of evaporation, drying out of adhesive coating materials, etc. It is therefore desired to provide a mechanism for adjusting the position of the doctor blade 136 with respect to the applicator surfaces 44 of the applicator roll 42 at a position external from the applicator housing 14. Additionally in this regard, it is desired to have such adjustment be accomplished at a position out of the path of movement of sheet items 12 into and through the applicator housing 14.

Figure 12:
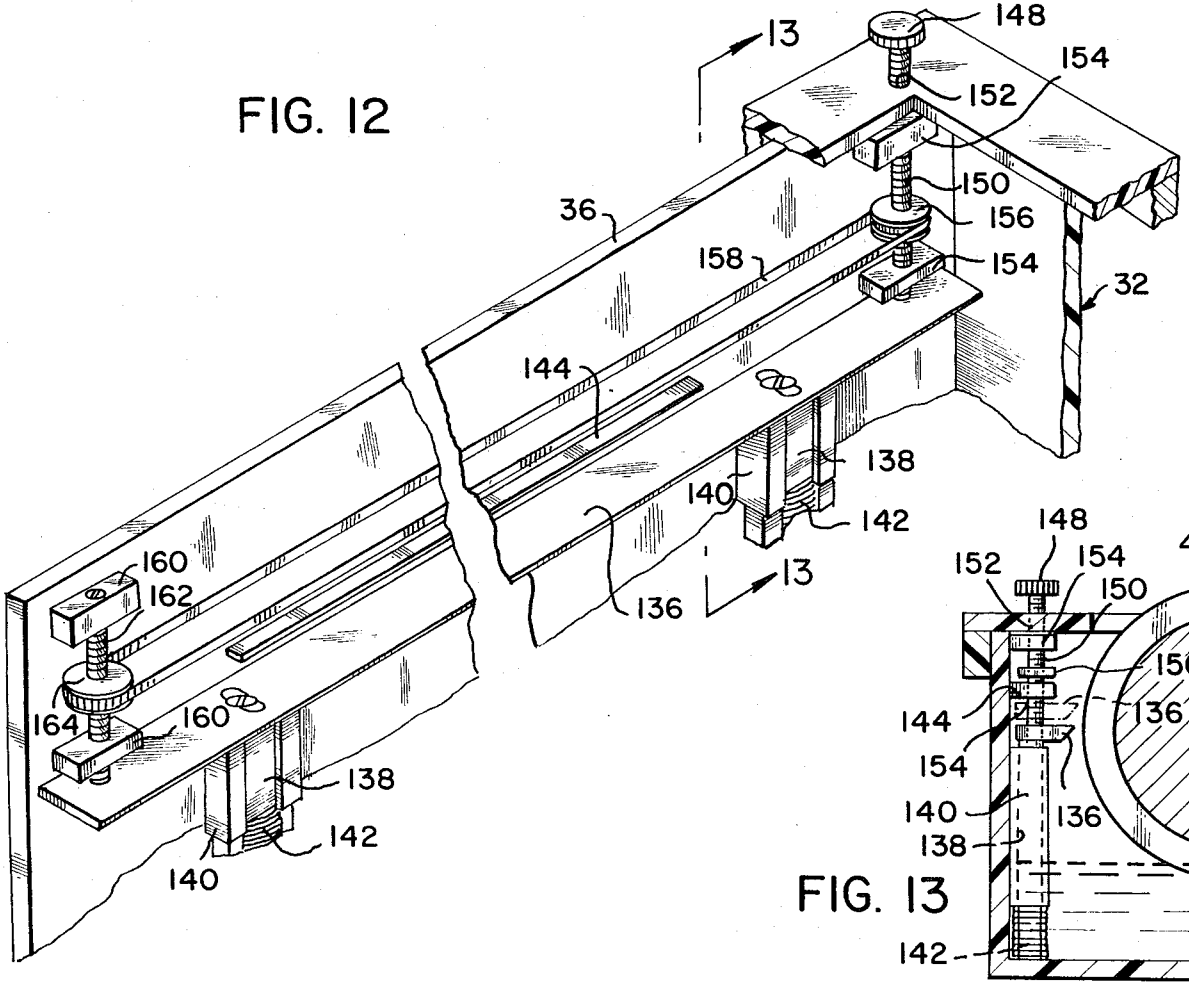
FIG. 12 is a perspective view illustrating a doctor blade mechanism in accordance with a still further aspect of the present invention, with the applicator roll being removed for illustrative purposes.
Figure 13:
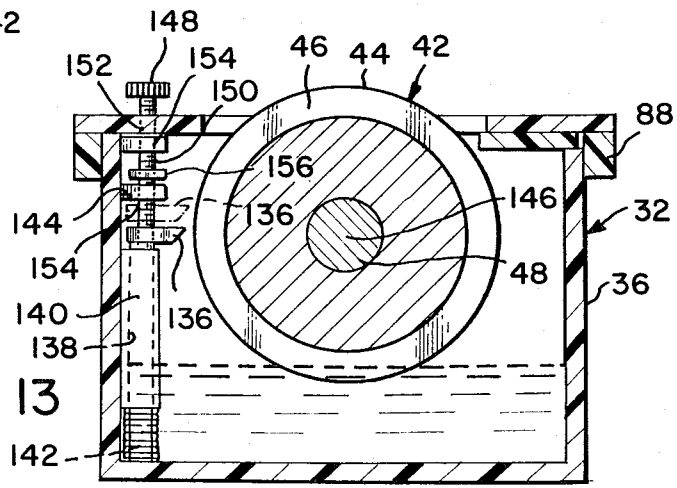
FIG. 13 is a side sectional view taken along the lines 13—13 of FIG. 12 illustrating the doctor blade mechanism in accordance with the present invention, one position of the doctor blade being illustrated in solid outline and a second position of the doctor blade being illustrated in dotted outline.

Such an adjustable doctor blade mechanism is illustrated most clearly in connection with FIGS. 12 and 13, and reference should therefore be made in such figures. In accordance with this aspect of the present invention, there is provided an elongated doctor blade 136 having a knife edge thereon which is mounted in a suitable manner on a pair of slidable members 138 arranged at spaced positions along the length of the doctor blade 136. In this regard, it is to be noted from FIG. 12 that the position of the doctor blade 136 with respect to the slide members 138 is adjustable by means of the slotted interconnection between the doctor blade 136 and the slide members 138. Each of the slide members 138 is adapted to be vertically slidably received within U-shaped guide tracks 140 which are fixedly secured to the inside wall of the container 36. Spring means 142 are provided for normally urging the slide members 138 vertically upward. Additionally, an elongated stop member 144 is also fixedly secured to the sidewall of the container 36 to prevent upward movement of the doctor blade 136 beyond a predetermined position.

Preferably, the lower extent or position of the slide members 138 is controlled by the bottom of the container 36, or by some other suitable device, so that the upper knife edge of the doctor blade 136, when the slide members 138 are in the lowest position is arranged precisely at the horizontal center line of the applicator roll 42, i.e., precisely at the elevation of the axis 146 of rotation of the applicator roll 42. In assemblying the apparatus, initially the slide members 138 are urged into their lowermost position against the spring means 142, and the position of the doctor blade 136 with respect to the slide members 138 is adjusted, with the use of a suitable feeler guage, to provide a predetermined minimum distance between the knife edge of the doctor blade 136 and the applicator surfaces 44 of the applicator roll 42. Conveniently, this minimum distance may correspond to 0.001 inches. The stop member 144 controlling the upper position of the doctor blade 136 is preferably set so that when the doctor blade 136 is in its second position in engagement therewith, the distance between the knife edge of the doctor blade 136 and the applicator surfaces 44 is at a predetermined maximum distance, such as for example 0.010 inches. Of course, if desired, the doctor blade 136 could be set at different minimum and maximum distances to provide a different range of coating thicknesses. This could be accomplished by varying of the setting or positions of the doctor blade 136 with respect to slide members 138 and varying the position of the stop member 144.

In order to control the positioning of the doctor blade 136 with respect to the applicator surfaces 44 between the upper and lower limits, a suitable interconnection mechanism is provided which is coupled to an externally arranged adjustment member 148. The adjustment member 148 is positioned so that it lies outside the path of movement of the sheet items 12 to the applicator roll 42. In this regard, it will be noted from FIGS. 1, 12, and 13 that the adjustment member 148 comprises an adjustment knob 148 arranged on the cover plate 88 of the container 36 outside of the dome section 34 and at one end of the container 36 so as to be accessible out of the path of movement of the sheet material 12. This position is shown in FIG. 1 to comprise the left-hand side portion of the apparatus 10, just inside the upwardly extending section 24 of the left-hand sidewall 18 of casing 16 forwardly of the dome section 34. The adjustment knob 148 is mounted on a shaft 150 which extends into the interior of the container 36 through a suitable aperture 152 in the cover plate 88. Suitable sealing means, such as a gasket (not shown), are provided for the aperture 152 in the cover plate 88 to effectively prevent any leakage of air therethrough into the interior of the applicator housing 14. The shaft 150 is threaded along a portion of its length and is received in a pair of guide blocks 154 fixedly mounted on the inner front sidewall of the container 36 as shown in FIG. 12. The lower end of the shaft 150 is directly in engagement with the upper surface of the doctor blade 136 at one end. Intermediate the two guide blocks 154 there is mounted a pully 156 having a belt means 158 trained thereabout. A similar set of spaced guide blocks 160 are provided adjacent the other end of the doctor blade 136 and are also fixedly mounted to the inner front sidewall of the container 36. A second threaded shaft 162 is received in the second set of guide blocks 160 and has its lower end in engagement with the other end of the doctor blade 136, as best seen in FIG. 12. The upper end of the threaded shaft 162 terminates so that it does not extend through the cover plate 88 of the container 36. A similar pulley 164 is provided for the belt means 158 on the threaded shaft 162 intermediate the second set of guide blocks 160.

It will thus be appreciated that with this arrangement, rotation of the shaft 150 will, via the interconnecting pulleys 156, 164 and belt means 158, serve to cause corresponding rotation of the other shaft 162. Because of the threaded interconnection of the shafts 150, 162 within their respective guide blocks 154, 160, rotation of the shaft 150 will accordingly serve to cause the ends of the two shafts 150, 162 to move upwardly or downwardly, depending on the direction of rotation. As the lower ends of the shafts 150, 162 are in contact with the doctor blade 136, which is biased upwardly by the spring means 142, movement of the shafts 150, 162 upwardly or downwardly serves to effect movement of the doctor blade 136 upwardly or downwardly. The extent of upward or downward movement of the doctor blade 136 is controlled by the upper stop member 144 and the bottom of the container 36 (or other suitable bottom stop means) respectively. Accordingly, simply by rotating the adjustment knob 148 which is mounted externally of the applicator housing 14, the precise position of the doctor blade 136 with respect to the applicator roll 42 may be easily controlled. In this regard, by using 10–32 threads for the threaded shafts 150, 162, a 0.010 inch movement only requires approximately $\frac{1}{3}$ of a revolution of the adjustment knob 148. A suitable scale (not shown) may be provided on the cover plate 88 to indicate the upper and lower settings as well as intermediate settings, as will be readily understood by persons skilled in the art.

Further, it should be noted that other types of interconnection means could be used for effecting corresponding rotation of the two threaded members 150, 162 in their respective guide blocks 154, 160. For example, the pulleys 156, 164 and belt means 158 could be replaced with pinion gears mounted on each of the shafts 150, 162 and a slidable rack positioned therebetween for effecting corresponding rotation of the threaded shafts 150, 162. Also, other well-known interconnecting means could be employed. In this regard, it is preferable that the two threaded shafts 150, 162 be located so as to engage the doctor blade 136 at spaced positions in order to insure effective and precise control of the vertical movement of the doctor blade 136 upwardly or downwardly, while maintaining the doctor blade generally parallel to the axis 146 of the applicator roll 42.

Thus, it will be appreciated that this arrangement for adjusting the position of the doctor blade 136 is most convenient in that adjustment can be made without having to remove the cover plate 88 from the container 36, and further can be accomplished while sheet materials 12 are being coated since the adjustment member 148 is mounted externally of the applicator housing 14 and in a position which is out of the path of movement of the sheet materials 12. Here it should be noted that if the adjustment knob 148 were provided adjacent the center of the doctor blade 136, i.e., between the two longitudinal ends, it would effectively interfere with the feed of the sheet items 12 through the applicator housing 14. Also, if it were provided on the front wall or end walls of the container 36 it would not readily be accessible without disassembly of the apparatus 10.

Therefore, it will be appreciated that in accordance with the present invention, there is provided an apparatus 10 for applying coating material to a sheet material 12. The apparatus 10 comprises reservoir means 32 for containing a supply of coating material and an applicator roll 42 which includes a plurality of substantially cylindrical applicator surfaces 44 along the length thereof separated by a plurality of grooves 46. The applicator roll 42 is rotatably mounted with respect to the reservoir means 32 so that coating material is received by the applicator surfaces 44 and applied to a sheet material 12 placed in contact with the applicator surfaces 44 during rotation of the applicator roll 42 and so that the applicator roll 42 then moves the sheet material 12 during rotation in a direction toward a downstream surface located downstream of the applicator roll 42. Deflector means 128 are provided for the applicator roll 42 which includes protruding portions 132 and raised surface portions 134 thereon. The deflector means 128 is supported with respect to the applicator roll 42 so as to be disposed intermediate the applicator roll 42 and the downstream surface so that the protruding portions 132 are disposed in the grooves 46 of the applicator roll 42 to cause the sheet material 12 being moved by the applicator roll 42 to separate from the applicator roll 42 and be moved onto the raised surface portions 134. The raised surface portions 134 are such as to prevent contact of the coated surface of the sheet material 12 with the downstream surface as the sheet material 12 leaves the applicator roll 42. In this manner, effective separation of the sheet material 12 from the applicator roll 42 will be provided, while at the same time smearing or loss of coating material from the sheet material 12 is minimized.

Furthermore, in accordance with another aspect of the present invention, housing means 14 for providing a substantially enclosed interior for the reservoir means 32 and applicator roll 42 is provided, the housing means 14 being sealable to seal the interior thereof from exposure to the surrounding atmosphere, and including moveable opening means 34 for providing access for a sheet material 12 to the rotatable applicator roll 42. The housing means 14 further includes at least one wall **36*a* having an aperture 64 therein of a predetermined size through which a shaft 48 operatively coupled to the rotatable applicator roll 42 extends. Sealing means 66, 74 are provided for sealing the aperture 64 to prevent exposure of the interior of the housing means 14 to the atmosphere through the aperture 64. The sealing means 66 has an outer peripheral dimension which is greater than the predetermined size of the aperture 64 through which the shaft 48 extends and is disposed to be in contact with the portion of the wall 36*a* surrounding the aperture 64 to thereby create a seal between the aperture 64 and the sealing means 66. Additionally, the sealing means 66 has a cylindrical transverse bore 68 therethrough for receipt of the shaft 48 therethrough. The interior of the bore 68 includes an inner groove 70 therein and the shaft 48 includes an outer groove 72 thereon disposed to be in alignment with the inner groove 70 of the bore 68. Ring sealing means 74 are provided which includes an inner portion disposed in the outer groove 72 of the shaft 48 and an outer portion disposed in the inner groove 70 of the bore 68 to thereby provide an effective seal of the shaft 48 and aperture 64 in the housing wall 36*a*. This arrangement provides a convenient and effective means for insuring that the interior of the housing means 14 is sealed from the surrounding atmosphere, while at the same time providing a simplified arrangement by which a drive device 54 and suitable coupling means 52, 50 may be arranged exteriorly of the housing means 14**.

Still further, if an aperture 116 for a shaft 60 is provided in a movable wall **34*d* having a recessed portion 122 surrounding the aperture 116, the sealing means may comprise a cover member 120 having a bore 118 therethrough sized to sealingly receive the shaft 60 therein, the cover member 120 in turn being received in the recessed portion 122 of the movable wall 34*d* so as to be in contact therewith. The dimensions of the cover member 120 are greater than the dimensions of the elongated aperture 116 and less than the dimensions of the recessed portion 122 of the movable wall 34*d* so that the cover member 120 covers the elongated aperture 116 irrespective of the position of the movable wall 34*d* and is slidably movable relative to the recessed portion 122. Such an arrangement also provides an effective seal to prevent exposure of the interior of the housing means 14 to the atmosphere through the aperture 116** through which the shaft extends.

Still further in accordance with the present invention, there is provided an adjustable doctor blade 136 which is positioned in the housing means 14 having the reservoir means 32 therein for controlling the thickness of coating material received by the applicator roll 42 during rotation of the applicator roll 42. The doctor blade 136 is mounted so as to be parallel to the axis 146 of the rotatable applicator roll 42 and movable between first and second positions along a direction transverse to the axis 146 of the applicator roll 42 to adjust the spacing between the doctor blade 136 and the applicator surface 44 of the applicator roll 42. A movable adjustment member 148 for adjusting the position of a doctor blade 136 between the first and second positions is mounted externally of the housing means 14 out of the path of movement of the sheet material 12 and positioned so as to be accessible during feeding of the sheet material 12 to the applicator roll 42. Coupling means 150, 156, 158, 162, 164, are provided for coupling the adjustment member 148 to the doctor blade 136 for effecting movement of the doctor blade 136 between the first and second positions in response to movement of the adjustment member 148, the coupling means 150, 156, 158, 162 being coupled to act upon the doctor blade 136 at two spaced positions along its length in a manner to insure that the doctor blade 136 remains parallel to the axis 146 of the applicator roll 42 during adjustment of its position. Such an arrangement is particularly useful in connection with a sealable applicating system in order to provide the capability of adjusting the thickness of the coating to be applied to the sheet material 12 without the necessity of having to expose the interior of the sealed housing 14 to the surrounding atmosphere, thereby possibly leading to evaporation and/or loss of coating material during such an adjustment operation.

While the preferred embodiments of the present invention have been shown and described, it will be understood that such are merely illustrative and that changes may be made without departing from the scope of the invention as claimed.

What is claimed is:

1. Apparatus for applying a coating material to a sheet material, said apparatus comprising:

housing means for providing a substantially enclosed interior, said housing means including reservoir means for containing a supply of coating material to be coated on a sheet material;

a rotatable applicator roll mounted in the interior of said housing means for receiving coating material from said reservoir means and for then applying said coating material to a sheet material;

said housing means being sealable to seal the interior thereof from exposure to the surrounding atmosphere, and including movable opening means for providing access for a sheet material to said rotatable applicator roll;

said housing means further including a wall having an aperture of a predetermined size therein;

a shaft operatively coupled to said rotatable applicator roll for rotation therewith and extending through said aperture in said wall of said housing means;

sealing means for sealing said aperture to prevent exposure of the interior of said housing means to the atmosphere through said aperture, said sealing means having an outer peripheral dimension which is greater than said predetermined size of said aperture and being disposed to be in contact with the portion of said wall surrounding said aperture to thereby create a seal between said aperture and said sealing means, and said sealing means having a cylindrical transverse bore therethrough for receipt of said shaft therethrough, the interior of said bore including an inner groove therein and said shaft including an outer groove therein disposed to be in alignment with said inner groove of said bore, and said sealing means further including ring sealing means having an inner portion disposed in said outer groove of said shaft and an outer portion disposed in said inner groove of said bore.

2. The apparatus of claim 1 wherein said sealing means has a transverse outer surface which includes a recessed groove therein, said sealing means being disposed in said aperture with said portion of said wall of said housing means surrounding said aperture received in said recessed groove.

3. The apparatus of claim 2 wherein said aperture in said wall is elongated having a predetermined width and a predetermined length; wherein said sealing means comprises a first sealing member which is substantially cylindrical and which has an outer peripheral dimension which is greater than said predetermined width and less than said predetermined length of said elongated aperture, the transverse outer surface of said cylindrical first sealing member including an outer cylindrical groove therein, and a second sealing member for sealing mating engagement with said cylindrical first sealing member, the width of said second sealing member being greater than said predetermined width of said elongated aperture and having a recessed groove in the outer transverse surface thereof for receipt of a part of said portion of said wall of said housing means about said aperture, said second sealing member being shaped to correspondingly mate with a portion of the outer cylindrical surface of said cylindrical first sealing member and including a protruding tab received in the outer cylindrical groove of said cylindrical first sealing member, the longitudinal length of said second sealing member being such that the overall longitudinal length of said cylindrical first sealing member and said second sealing member when sealingly mated is greater than said predetermined length of said elongated aperture.

4. The apparatus of claim 3 wherein said aperture extends from an edge of said wall of said housing means, and wherein said second sealing member includes an edge portion terminating at the edge of said wall of said housing means when disposed in said aperture in sealing mating engagement with said cylindrical first sealing member.

5. The apparatus of claim 1 wherein said sealing means comprises a cover member of a predetermined shape and dimension, and wherein said portion of said wall surrounding said aperture is recessed and so sized and shaped as to receive said cover member therein to be in contact with said recessed portion of said wall.

6. The apparatus of claim 1 further including drive means located outside of said housing means for rotating said applicator roll, said drive means being operatively connected to said shaft extending through said aperture.

7. The apparatus of claim 1 wherein said sealing ring means comprises an O-ring.

8. The apparatus of claim 7 wherein said O-ring is made of teflon.

9. The apparatus of claim 1, wherein said applicator roll has a plurality of substantially cylindrical applicator surfaces along the length thereof separated by a plurality of grooves, said applicator roll being mounted with respect to said housing means so that the coating material in said reservoir means is received by said applicator surfaces and applied to said sheet material during rotation of said applicator roll and so that said applicator roll then moves said sheet material during rotation in a direction toward a downstream surface located downstream of said applicator roll; and further including deflector means for said applicator roll, said deflector means including protruding portions and raised surface portions thereon, said deflector means being supported with respect to said applicator roll so as to be disposed intermediate said applicator roll and said downstream surface and so that said protruding portions are disposed in said grooves of said applicator roll to cause said sheet material being moved by said applicator roll to separate from said applicator roll and be moved onto said raised surface portions, said raised surface portions being such as to prevent contact of said coated surface of said sheet material with said downstream surface as said sheet material leaves said applicator roll.

10. The apparatus of claim 9 wherein said raised surface portions are aligned with said grooves in said applicator roll so that coated portions of said sheet material do not contact said raised surface portions as said sheet material leaves said applicator roll.

11. The apparatus of claim 9, further including means for introducing a supply of coating material into said reservoir means so as to maintain a predetermined level of coating material in said reservoir means, said predetermined level being such that said coating material does not extend fully into said grooves of said applicator roll as said applicator roll is rotated.

12. The apparatus of claim 9 further including a guide roll for urging a sheet material into contact with said applicator roll, said guide roll being arranged in spaced relationship to said applicator roll to define a gap between the surface of said guide roll and said applicator surfaces of said applicator roll through which a sheet material may be introduced for coating of coating material thereon, whereby said coating material is applied by said applicator surfaces in a series of spaced strips.

13. Apparatus for applying a coating material to a sheet material, said apparatus comprising:

housing means for providing a substantially enclosed interior, said housing means including reservoir means for containing a supply of coating material to be coated on a sheet material;

a rotatable applicator roll mounted in the interior of said housing means for receiving coating material from said reservoir means and for then applying said coating material to a sheet material;

said housing means being sealable to seal the interior thereof from exposure to the surrounding atmosphere, and including movable opening means for providing access for a sheet material to said applicator roll, said movable opening means including a movable wall member which is movable between a first sealed position and a second open position, said movable wall member including an elongated aperture therein;

a shaft operatively coupled to said rotatable applicator roll and extending through said elongated aperture in said movable wall member, said elongated aperture being sized so that movement of said movable wall member between said first and second positions does not effect movement of said shaft; and sealing means for sealing said aperture to prevent exposure of the interior of said housing means to the atmosphere through said aperture, said sealing means comprising a cover member having an aperture therethrough sized to sealingly receive said shaft therein, and said movable wall member including a recessed portion surrounding said aperture and receiving said cover member therein so as to be in contact with said wall member, the dimensions of said cover member being greater than the dimensions of said elongated aperture and less than the dimensions of said recessed portion of said movable wall member so that said cover member covers said elongated aperture irrespective of the position of said wall member.

14. The apparatus of claim 13 wherein the width of said aperture is greater than the diameter of said shaft, and wherein said cover member includes a cylindrical boss protruding from a surface of said cover member and having a diameter corresponding to the width of said aperture, said boss being slidably received within said aperture when said cover member is positioned in said recessed portion in contact with said wall member to thereby permit relative movement of said wall member and said cover plate along a direction extending in the elongated direction of said aperture.

15. The apparatus of claim 13, further including means for adjusting the position of said shaft relative to said housing means.

16. The apparatus of claim 13 further including a guide roll arranged in spaced relationship with respect to said applicator roll, and means for coupling said shaft to said guide roll and said applicator roll to effect rotation thereof.

17. The apparatus of claim 16 wherein said shaft comprises a first shaft connected to said guide roll, and further including a second shaft connected to said applicator roll and extending out of said housing means, and gear means for said first and second shafts so that rotation of said applicator roll effects rotation of said guide roll.

18. The apparatus of claim 17 wherein said movable opening means comprises a dome member overlying said reservoir means and said applicator roll, and wherein said dome member includes said aperture therein and has said guide roll mounted therein with said first shaft extending through said aperture of said dome member; and means for moving said dome member between said first sealed position in which said reservoir means and said applicator roll are sealed from the surrounding atmosphere, and said second open position in which a sheet material may be fed to said applicator roll between said guide roll and said applicator roll.

19. The apparatus of claim 13, wherein said applicator roll has a plurality of substantially cylindrical applicator surfaces along the length thereof separated by a plurality of grooves, said applicator roll being mounted with respect to said housing means so that the coating material in said reservoir means is received by said applicator surfaces and applied to said sheet material during rotation of said applicator roll and so that said applicator roll then moves said sheet material during rotation in a direction toward a downstream surface located downstream of said applicator roll; and further including deflector means for said applicator roll, said deflector means including protruding portions and raised surface portions thereon, said deflector means being supported with respect to said applicator roll so as to be disposed intermediate said applicator roll and said downstream surface and so that said protruding portions are disposed in said grooves of said applicator roll to cause said sheet material being moved by said applicator roll to separate from said applicator roll and be moved onto said raised surface portions, said raised surface portions being such as to prevent contact of said coated surface of said sheet material with said downstream surface as said sheet material leaves said applicator roll.

20. The apparatus of claim 19 wherein said raised surface portions are aligned with said grooves in said applicator roll so that coated portions of said sheet material do not contact said raised surface portions as said sheet material leaves said applicator roll.

21. The apparatus of claim 19, further including means for introducing a supply of coating material into said reservoir means so as to maintain a predetermined level of coating material in said reservoir means, said predetermined level being such that said coating material does not extend fully into said grooves of said applicator roll as said applicator roll is rotated.

22. The apparatus of claim 19 further including a guide roll for urging a sheet material into contact with said applicator roll, said guide roll being arranged in spaced relationship to said applicator roll to define a gap between the surface of said guide roll and said applicator surfaces of said applicator roll through which a sheet material may be introduced for coating of coating material thereon, whereby said coating material is applied by said applicator surfaces in a series of spaced strips.

23. Apparatus for applying a coating material to a sheet material, said apparatus comprising:

housing means including reservoir means therein for containing a supply of coating material to be coated on a sheet material;

an applicator roll having a cylindrical applicator surface and a longitudinally extending axis, said applicator roll being rotatably mounted in said housing means to rotate about said axis and positioned relative to said reservoir means so as to receive coating material on said applicator surface during rotation and to then apply said received coating material to a sheet material being fed to said applicator roll along a path of movement extending in a direction transverse to said axis of said applicator roll;

a doctor blade positioned in said housing means for controlling the thickness of coating material received by said applicator roll during rotation of said applicator roll;

mounting means for mounting said doctor blade so as to be parallel to said axis and movable between first and second positions along a direction transverse to said axis of said applicator roll to adjust the spacing between said doctor blade and said applicator surface of said applicator roll while maintaining said doctor blade parallel to said axis of said applicator roll;

a movable adjustment member for adjusting the position of said doctor blade between said first and second positions, said adjustment member being mounted externally of said housing means out of said path of movement of said sheet material and positioned so as to be accessible during feeding of said sheet material to said applicator roll;

coupling means for coupling said adjustment member to said doctor blade for effecting movement of said doctor blade between said first and second positions in response to movement of said adjustment member, said coupling means being coupled to act upon said doctor blade at two spaced positions along the length of said doctor blade in a manner to insure that said doctor blade remains parallel to said axis of said applicator roll during adjustment of its position relative to said applicator surface of said applicator roll; and wherein said coupling means comprises first and second spaced members movable along a direction parallel to the direction of movement of said doctor blade between said first and second portions, and interconnecting means coupling said first and second spaced members so that movement of said first member along said direction of movement serves to effect movement of said second member along said direction of movement, and wherein said adjustment member is operatively connected to said first member for moving said first member along said direction.

24. The apparatus of claim 23 wherein said mounting means comprises means for supporting said doctor blade for sliding movement in a plane which is parallel to said axis of said applicator roll.

25. The apparatus of claim 24 wherein the distance between said doctor blade and said applicator surface of said applicator rolls is a predetermined minimum distance when said doctor blade is in said first position.

26. The apparatus of claim 25 wherein said means for supporting said doctor blade for sliding movement comprises slide means to which said doctor blade is secured and guide means affixed to said housing means for mounting said slide means for slidng movement along a plane parallel to said axis of said applicator roll, said doctor blade being secured to said slide means so that the distance between said doctor blade and said applicator surface of said applicator roll is said predetermined minimum distance when said doctor blade is in said first position.

27. The apparatus of claim 26 wherein said doctor blade is adjustably secured to said slide means to adjust said predetermined minimum distance.

28. The apparatus of claim 26 further including biasing means for urging said doctor blade towards said second position.

29. The apparatus of claim 28 wherein said slide means comprises a pair of slide members; wherein said guide means comprises a pair of guide members fixedly secured to said housing means for receiving said slide members for sliding movement; and wherein said biasing means comprises spring means for urging said slide members for movement in said guide members in a direction to move said doctor blade toward said second position.

30. The apparatus of claim 26 wherein said slide means are mounted for vertical movement in said guide means, and wherein said doctor blade when in said first position is horizontally displaced from said axis of rotation of said applicator roll.

31. The apparatus of claim 23 wherein said mounting means includes a stop member engagable with said doctor member for preventing movement of said doctor blade in a direction away from said first position.

32. The apparatus of claim 23 wherein said first and second members comprise first and second threaded members threadably mounted in guide blocks secured to said housing means; wherein said adjustment member is rotatably connected to said first threaded member to rotate said first threaded member upon movement of said adjustment member; and wherein said interconnecting means is operative to rotate said second threaded member in response to rotation of said first threaded member.

33. The apparatus of claim 32 wherein said interconnecting means comprises pulley means mounted on each of said first and second threaded members and belt means trained around said pulley means.

34. The apparatus of claim 23, further including a cover for said housing means having an aperture therein displaced from said path of movement; and wherein said adjustment member includes a shaft extending through said aperture in said cover and means for sealing said aperture in said cover to prevent exposure of the interior of said housing means to the surrounding atmosphere through said aperture.

35. The apparatus of claim 34 wherein said path of movement of said sheet member extends in a longitudinal direction which is perpendicular to said axis, and wherein said aperture is displaced laterally of said longitudinal direction.

36. The apparatus of claim 23, wherein said applicator roll has a plurality of cylindrical applicator surfaces along the length thereof separated by a plurality of grooves, said applicator roll being rotatably mounted with respect to said housing means so that coating material in said reservoir means is received by said plurality of applicator surfaces and applied to said sheet material being fed to said applicator roll along said path of movement, and so that said applicator roll then moves said sheet material during rotation in a direction toward a downstream surface located downstream of said applicator roll; and further including deflector means for said applicator roll, said deflector means including protruding portions and raised surface portions thereon, said deflector means being supported with respect to said applicator roll so as to be disposed intermediate said applicator roll and said downstream surface and so that said protruding portions are disposed in said grooves of said applicator roll to cause said sheet material being moved by said applicator roll to separate from said applicator roll and be moved onto said raised surface portions, said raised surface portions being such as to prevent contact of said coated surface of said sheet material with said downstream surface as said sheet material leaves said applicator roll.

37. The apparatus of claim 36 wherein said raised surface portions are aligned with said grooves in said applicator roll so that coated portions of said sheet material do not contact said raised surface portions as said sheet material leaves said applicator roll.

38. The apparatus of claim 36, further including means for introducing a supply of coating material into said reservoir means so as to maintain a predetermined level of coating material in said reservoir means, said predetermined level being such that said coating material does not extend fully into said grooves of said applicator roll as said applicator roll is rotated.

39. The apparatus of claim 36, further including a guide roll for urging a sheet material into contact with said applicator roll, said guide roll being arranged in spaced relationship to said applicator roll to define a gap between the surface of said guide roll and said applicator surfaces of said applicator roll through which a sheet material may be introduced for coating of coating material thereon, whereby said coating material is applied by said applicator surfaces in a series of spaced strips.

* * * * *